US006997726B2

(12) United States Patent
Buden et al.

(10) Patent No.: US 6,997,726 B2
(45) Date of Patent: Feb. 14, 2006

(54) CONNECTOR HOUSING WITH SHORT-CIRCUIT BRIDGE

(75) Inventors: Vladimir Buden, Zagreb (HR); Zelimir Loncar, Zagreb (HR); Harald Michael Lutsch, Weitcrstadt (DE); Ranko Resman, Zagreb (HR)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 10/958,729

(22) Filed: Oct. 6, 2004

(65) Prior Publication Data

US 2005/0095888 A1 May 5, 2005

(30) Foreign Application Priority Data

Oct. 29, 2003 (DE) ..... 103 50 652

(51) Int. Cl.
*H01R 29/00* (2006.01)

(52) U.S. Cl. ..... 439/188; 439/352; 439/509; 200/51.1

(58) Field of Classification Search ..... 439/188, 439/912, 507–514, 488–489, 352–358, 189, 439/595, 944, 592, 490; 200/51.09, 51.1, 200/51 R See application file for complete search history.

(56) References Cited

U.S. PATENT DOCUMENTS 5,064,973 A * 11/1991 Zinn et al. ..... 200/51.1

FOREIGN PATENT DOCUMENTS

EP 95105844.5 10/1995

EP 1 235 306 A2 8/2002

(Continued)

OTHER PUBLICATIONS

Patent Abstracts of Japan; Publication No. 2002033165 A; Jan. 31, 2002; Sumitomo Wiring Systems, Ltd.

*Primary Examiner*—Gary Paumen
*Assistant Examiner*—Edwin A. Leon
(74) *Attorney, Agent, or Firm*—Sughrue Mion, PLLC

(57) ABSTRACT

A connector housing has a longitudinal axis and includes a first housing portion, having a front end face and a rear end, and at least two accommodation chambers extending parallel to the longitudinal axis, and receiving respectively an electrical contact element, and having a connector tab. The accommodation chambers have, respectively, an insertion opening for a mating contact element and an exiting opening for the connector tab, open to the front end face. An elastic locking arm is provided for each accommodation chamber for retaining the contact element in the accommodation chamber. A second housing portion is formed integrally with the first housing portion and forms an accommodation chamber, into which a portion of a housing of a mating connector can be inserted. The second housing portion has contact elements having female contact terminals, which can be electrically connected to the contact elements. A short-circuit bridge, made from an electrically conductive material, is retained in the first housing portion and includes for each contact element an elastic contact arm. The contact arms are connected to each other and serve to contact the connector tabs. In an initial position, a front holder supports the contact arms in the lifted position and in the final position leaves these unloaded, so that these can contact the connector tabs.

7 Claims, 4 Drawing Sheets

U.S. PATENT DOCUMENTS 5,295,846 A * 3/1994 Sumida et al. ..... 439/188
6,106,315 A 8/2000 Lalange et al.
6,257,922 B1 * 7/2001 Shinozaki ..... 439/489
6,659,789 B1 * 12/2003 Nagamine et al. ..... 439/352
6,932,643 B1 * 8/2005 Bigotto ..... 439/507
2002/0146281 A1 10/2002 Murakami

FOREIGN PATENT DOCUMENTS

EP 02004235.4 8/2002

* cited by examiner

CONNECTOR HOUSING WITH SHORT-CIRCUIT BRIDGE

BACKGROUND OF THE INVENTION

The invention relates to a connector housing and a connection comprising the connector housing and a mating connector. The invention relates especially to a connector housing with a short-circuit bridge to short-circuit the contact elements which are provided with a connector tab.

EP 1 235 306 A2 describes a connector housing with accommodation chambers for contact elements with female contact terminals, wherein the female contact terminals are inserted through an insertion opening into the accommodation chambers and are accessible through an opening in the front end face of the connector housing for the insertion of connector tabs. The contact elements are, respectively, retained in the accommodation chambers by a locking arm, which engages behind an edge on the mating contact element. Additionally, a front holder is provided, which enters into a gap between a wall of the first housing portion of the connector housing and the outer face of the locking arms, so that these are retained.

In connector housings with a short-circuit bridge the problem exists, that when inserting the contact element into the mating accommodation chamber the contact arms of the short-circuit bridge are in the rebound condition and thus, are in the movement area of the connector tabs projecting from the end face of the housing, so that the danger exists, that an inclined positioning of the contact elements is produced. Furthermore, the danger exists, that then, when a special coating on the connector tabs for the contact improvement is provided, a damage of the upper face of the connector tabs can be produced by the relative movement between the connector tabs and the contact area of the contact arms. Furthermore, the force, to be produced for the assembly of the contact elements, is, correspondingly, high, as the spring force of the contact elements has to be exceeded. Besides, when the contact elements are made from a high-conductive material, for example from a copper material, which is relatively soft, the connector tabs can be distorted.

The invention has, therefore, the object, to provide a connector housing, in which the contact elements can be mounted in an easy manner and the danger of damaging the same, is not produced, even though a short-circuit bridge is provided.

SUMMARY OF THE INVENTION

The object is solved according to the invention by a connector housing, comprising:

a first housing portion, having a front end face and a rear end, at least two accommodation chambers, extending parallel to the longitudinal axis and receiving respectively an electrical contact element, and having a connector tab, wherein the accommodation chambers have, respectively, an insertion opening for a mating contact element and an exiting opening for the connector tab, opening to the front end face, an elastic locking arm for each accommodation chamber for retaining the contact element in the accommodation chamber, a second housing portion, which is formed integrally with the first housing portion, and forms an accommodation chamber, into which a portion of a housing of a mating connector can be inserted, having mating contact elements, comprising female contact terminals, which, respectively, can be electrically connected to the contact elements, a short-circuit bridge, which is made from an electrically conductive material, retained in the first housing portion, comprises for each contact element an elastic contact arm, wherein the con-tact arms are connected to each other and serve to contact the connector tabs, and a front holder, which can be displaced between an initial position and a final position along the longitudinal axis, holds in the initial position the contact arms in a lifted position and leaves the same in the final position unloaded, so that these can contact the connector tabs.

Of advantage in this embodiment is, that the front holder primarily known for retaining the locking arms, can be used, additionally, to hold during the assembly of the contact elements, the contacts arms of the short-circuit bridge initially in a lifted-off lifted position, so that these cannot contact the connector tabs of the contact elements. Therefore, the assembly of the contact elements is as a whole facilitated. The insertion can be achieved by overcoming the spring force of the locking arms. The connector tabs themselves are not loaded on the tip during exiting from the exiting opening in the end face of the first housing portion, so that also no damage can be produced. Only then, when all contact elements are correctly mounted, i.e. when it is ensured, that the locking arms take up the correct locking position, the front holder can be displaced into its final position, so that the contact arms are released and are guided towards the connector tabs transversally to the longitudinal axis. Commonly, the contact arms of the short-circuit bridge come into contact to the connector tabs in an area close to an area of support, so that the danger of deforming the same is not given here.

In an embodiment of the invention it is provided, that the front holder has at least one first separation element, which holds in the initial position the contact arms of the short-circuit bridge in the lifted position and releases the same in the final position.

Advantageous is, when for each contact arm a first separation element is provided. Preferably, the front holder is formed frame-like and is taken-up in the final position at least partially in a countersunk manner in the front end face.

For improving the guiding the front holder has struts extending parallel to the longitudinal axis and supporting a crossbar.

Especially advantageous is, when the crossbar fills in the final position of the front holder a gap between a wall of the first housing portion and of the outer face of the locking arms facing away from the accommodation chambers in a direction transversally to the longitudinal axis. Thus, the locking arms are prevented from deflecting out of the locking position, so that a double retainment of the contact elements is produced in their position in the accommodation chambers. So, even when tensioning forces are produced onto a cable, connected to the contact element, in the sense of pulling the same out from the connector housing, no detachment is generated.

Furthermore, the object is solved by a connection comprising a connector housing according to one of claims and a mating connector, to which at least one second separation element is arranged, which separates the contact of the contact arms to the connector tabs while connecting to the connector housing.

A preferred embodiment of the connector housing and of a mating connector is represented in the drawing.

DETAILED DESCRIPTION OF THE INVENTION

Figure 1:
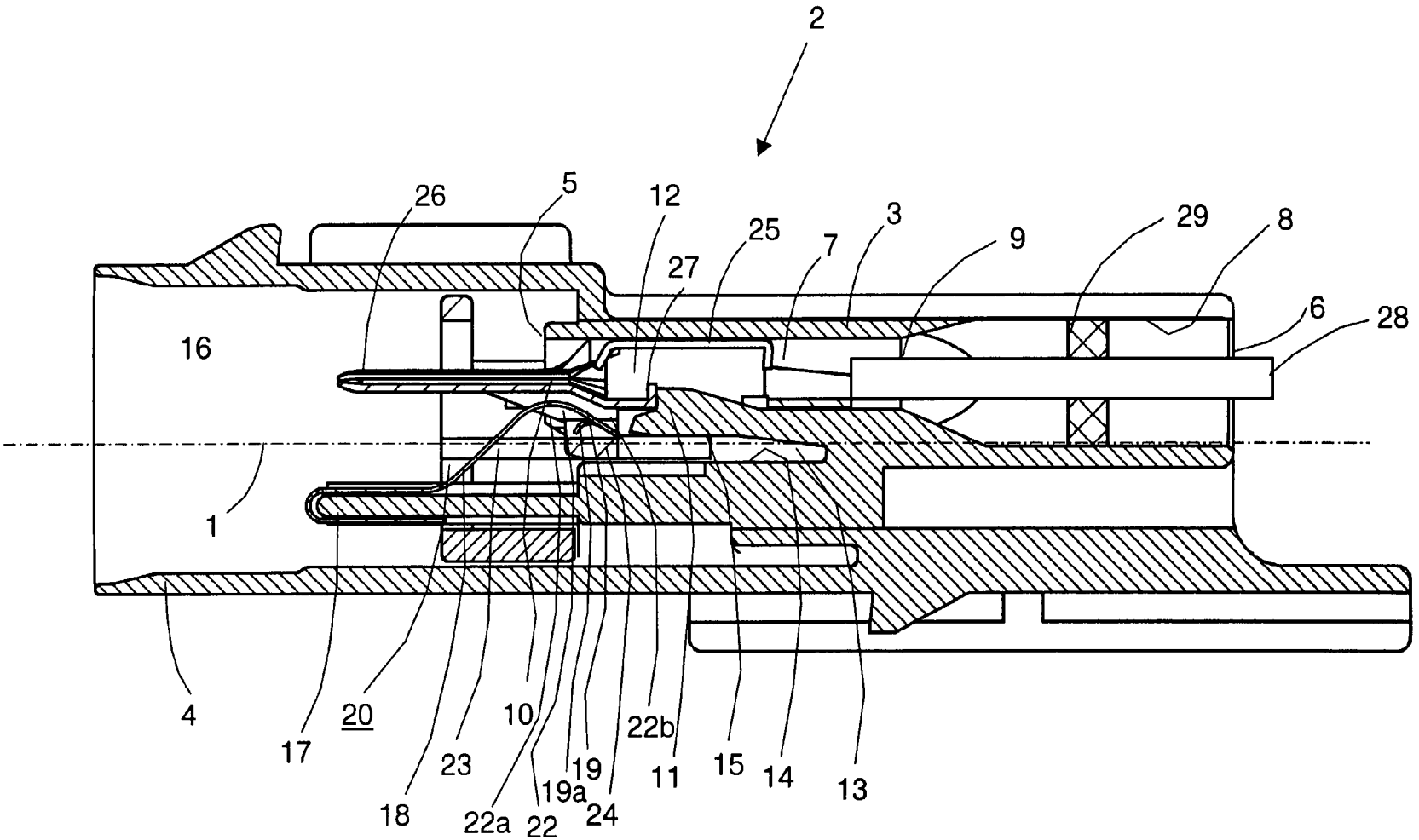
FIG. 1 is a longitudinal sectional view of a connector housing according to the invention in a plane of an accommodation chamber, with the front holder arranged in an initial position.

In FIG. 1 a connector housing 2 is visible, which has the longitudinal axis 1. The connector housing 2 comprises a first housing portion 3 and a second housing portion 4. The first housing portion 3 extends between a front end face 5 and a rear end 6. In the first housing portion 3 two accommodation chambers 7 are arranged, as the present example concerns a two-pole embodiment. The two accommodation chambers 7 extend parallel to the longitudinal axis, of which, however, only one is visible. The second accommodation chamber is arranged behind the visible accommodation chamber 7, i.e. behind the drawing plane.

The accommodation chamber 7 is open via an insertion opening 9 and an exiting bore 8 towards the rear end 6. In the front end face 5 an exiting opening 10 is provided, which communicates with the accommodation chamber 7. Furthermore, for each accommodation chamber 7, a locking arm 11 is provided, which is formed integrally with the first housing portion 3, however, is separated therefrom such that it can be elastically deformed. It has a locking projection 12, which in the relaxed condition of the locking arm 11, i.e., when not being acted on by a force, projects into the area of the accommodation chamber 7. Between the outer faces 15 of the locking arms 11 and the wall 14 of the first housing portion 3, a gap 13 is formed, into which the locking arm 11 can be elastically displaced. The second housing portion 4 formed integrally on the first housing portion 4, forms an accommodation chamber 16 for a housing portion of a mating connector.

This accommodation chamber 16 is arranged in front of the front end face 5 of the first housing portion 3.

In the first housing portion 3 a retaining lug 17 is provided transversally to the longitudinal axis 1 and offset thereto, on which the holding portion of an electrically conductive short-circuit bridge 18 is received. The retaining lug 17 projects from the front end face 5 into the accommodation chamber 16, and extends essentially parallel to the longitudinal axis 1. The short-circuit bridge 18 has in the present two-pole embodiment two contact arms 19, of which only one is visible. The second contact arm 19 is arranged in the drawing plane behind the visible contact arm 19 and is arranged distanced thereto, so that both can separately bend elastically. Starting from the holding portion of the short-circuit bridge 18, mounted on the retaining lug 19 which electrically connects the two contact arms 19, each contact arm 19 extends in the direction towards the front end face 5 up to a recess in the end face 5, i.e. approaching the longitudinal axis 1, and has towards the free end a lug 19*a* and a portion ex-tending again away from the longitudinal axis 1.

A front holder 20, arranged in the initial position in the accommodation chamber 16, is arranged to the connector housing 2. The front holder 20 has two first separation elements 22. These have, respectively, a lifting face 22*a* extending in the direction towards the rear end 6 and inclined towards the longitudinal axis 1 and has following thereto a retaining face 22*b*. The front holder 20 has struts 23, which extend from its front portion, formed as a frame 24, in the direction towards the rear end 6 and carry a crossbar 22 extending transversally to the longitudinal axis 1. The front holder 20 is made from an electrically insulating material. In the assembly of the front holder 20 the first separation elements 22, respectively, contact with one of the contact arms 19 the lug 19*a* provided in the area of the outwardly bent portion and lift, when further inserting the holder 20 in the direction towards the rear end 6, the contact arms 19 by means of sliding of the lugs 19*a* of the contact arms 19 on the lifting faces 22*a*, so that they are supported in a direction transversally to the longitudinal axis 1 distinctly outside of the exiting openings 10 in the front end face 5 on the retaining faces 22*b* following the lifting faces 22*a*.

In this position the front holder 20 remains until the assembly of the contact elements 25, which are, respectively, connected to a cable 28, is completed. The insertion of the contact elements 25 is carried out through the exiting bore 8 via the insertion opening 9 in the accommodation chamber 7, wherein the elastic locking arm 11 with its locking projection 12 is displaced from the area of the accommodation chamber 7 into the gap 13. When inserting the contact element 25, the connector tab 26 formed thereon, projects through the exiting opening 10 to the outside into the accommodation chamber 16 beyond the front end face 5. As the contact arms 19 are held distanced from the exiting openings 10 by the front holder 20, the insertion can easily be carried out without any frictional contact or a bending loading by the contact arms 19. When the final position is reached, the elastically deformed locking arm 11 can again take up its relaxed position, in which its locking projection 12 engages in front of a retaining edge 27 of the contact element 25. Between the cable 28 and the wall of the exiting bore 8, a seal 29 is arranged to achieve a watertight and moisture-tight connection.

Figure 2:
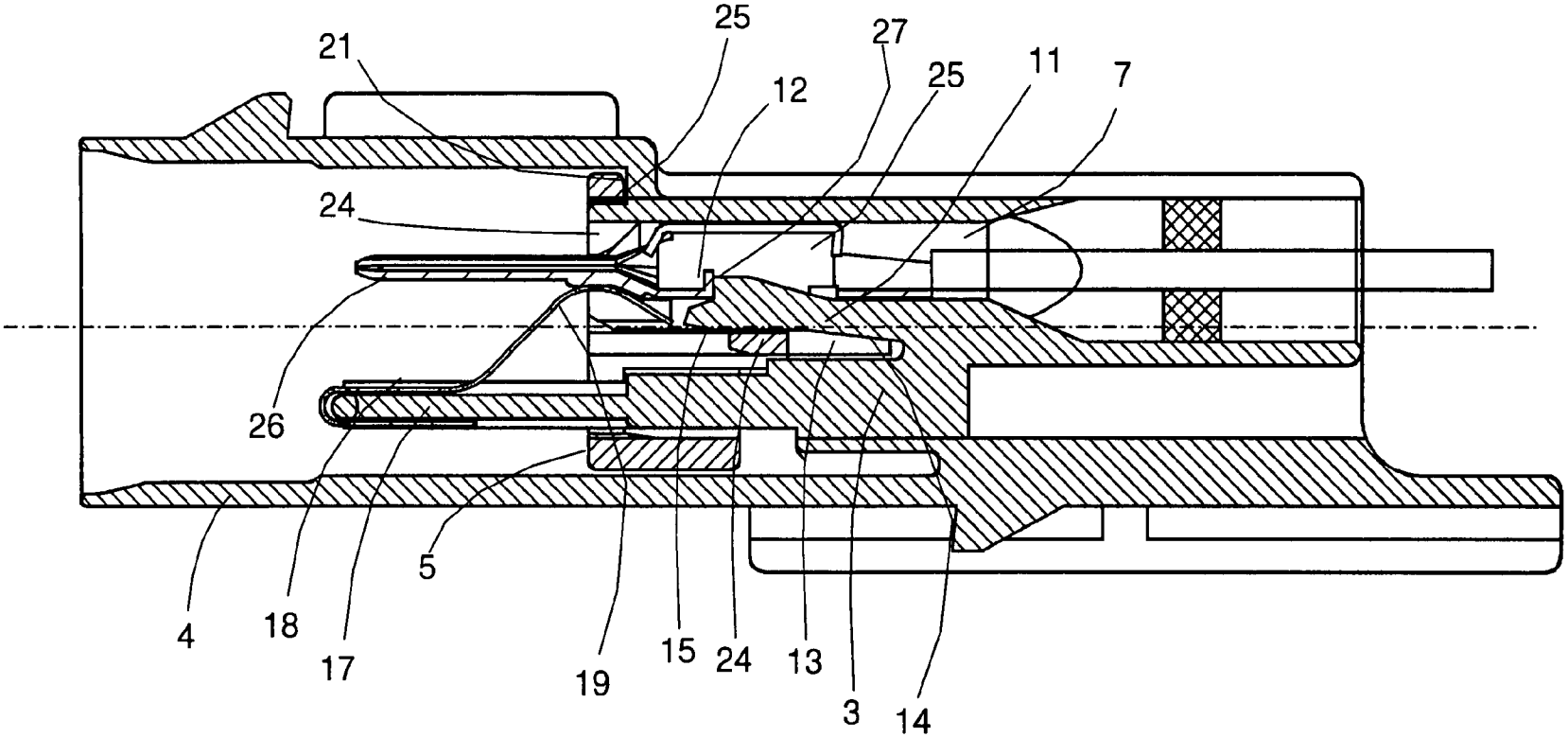
FIG. 2 is a longitudinal sectional view corresponding to FIG. 1, however, with the front holder arranged in the final position.

When all contact elements 25 are inserted in the above described manner and are secured by the mating locking arms 11 in the accommodation chambers 7, the front holder 20 can be moved along the longitudinal axis 1 in a direction towards the rear end 6, by which the first separation elements 22 come out of contact to the contact arms 19 and the crossbar 24 enters into the gap 13 between the wall 14 of the first housing portion 3 and the outer face 15 of the locking arms 11, so that the gap 13 is filled out in a direction transversally to the longitudinal axis 1. Thus, the locking arms 11 are retained in their locking position. Hereby, the front holder 20 takes up the position represented in FIG. 2, wherein the frame portion of the holder 20 is received in a recess 21 of the end face 5, so that it does not project over the front end face 5. From FIG. 2 it is further visible, that the contact arms 19 contact the connector tabs 26 of the contact elements 25.

Figure 3:
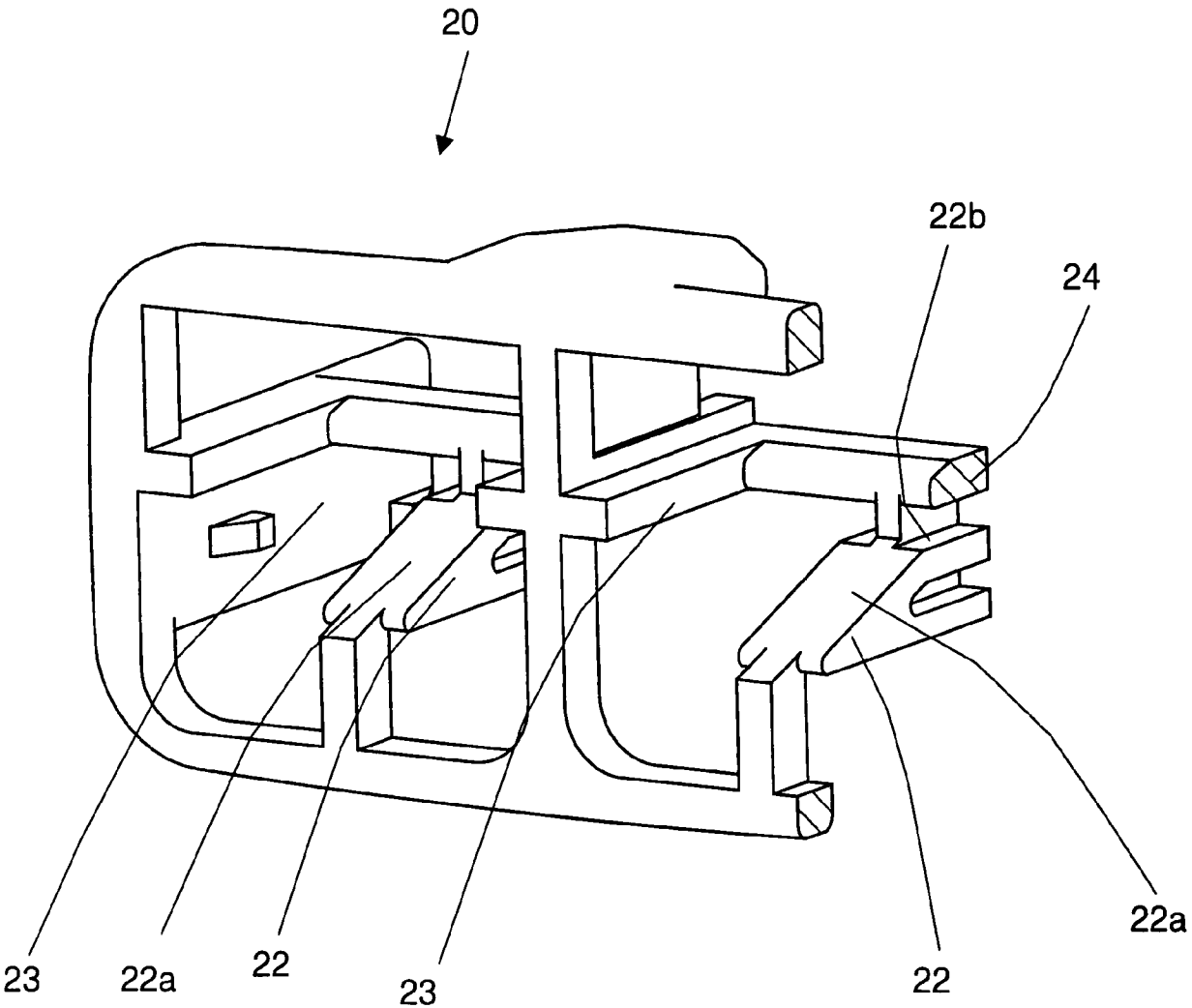
FIG. 3 is a perspective view of a front holder as an individual component.

In FIG. 3 the front holder 20 is shown as an individual component, which comprises a frame portion entering in the final position the recess 21 and struts 23 extending therefrom parallel to the longitudinal axis 1 and projecting from the frame portion and supporting on their free ends the crossbar 24, extending transversally to the longitudinal axis 1. Furthermore, the first separation elements 22 are visible, which, respectively are provided with a lifting face 22*a* and a retaining face 22*b*.

Figure 4:
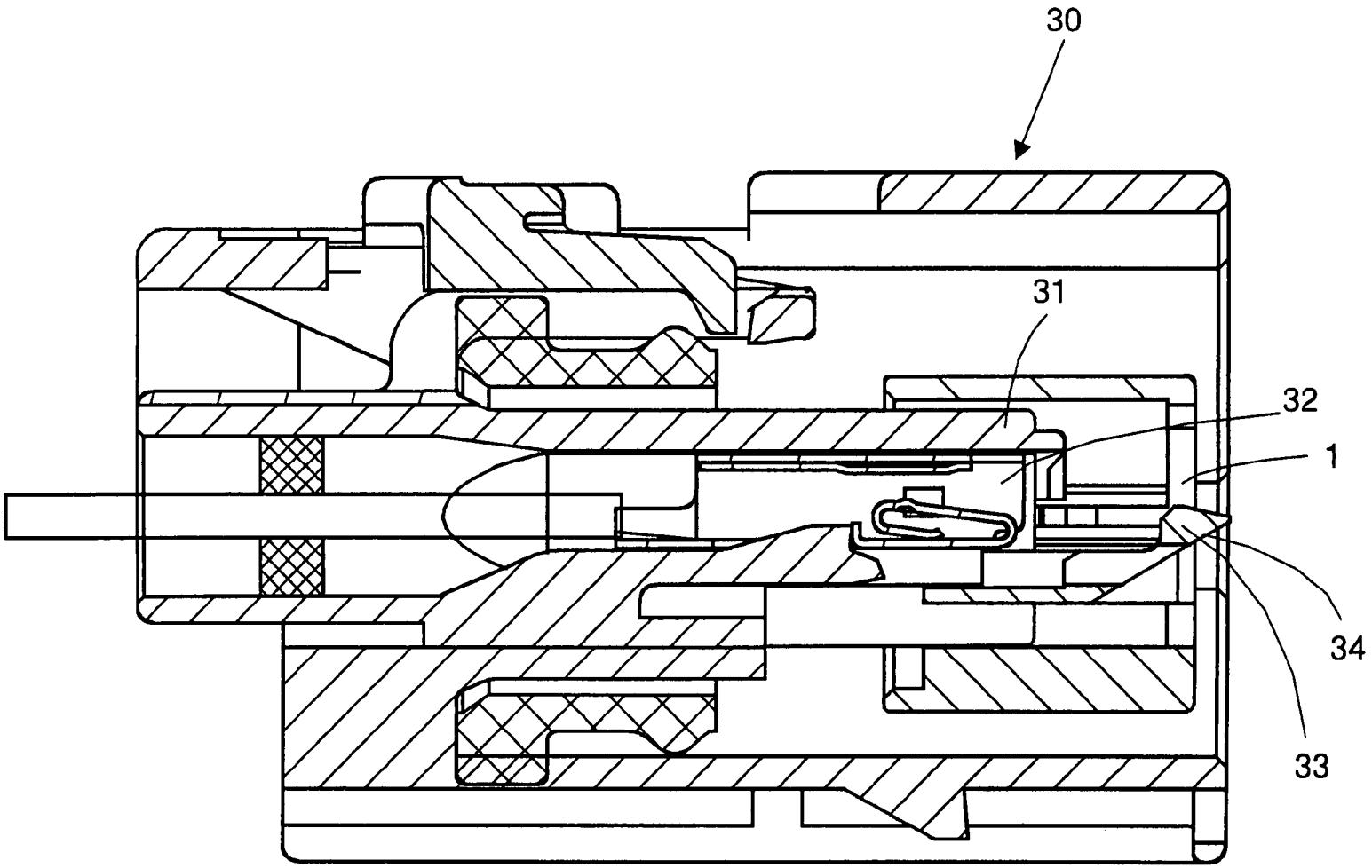
FIG. 4 is a longitudinal sectional view of a mating connector with a separation element.

FIG. 4 a mating connector 30 is shown, which has a portion 31, entering into the accommodation chamber 16 of the housing connector 2 while connecting the two. In this portion 31, also accommodation chambers are provided, into which, however, mating contact elements, formed as female contact terminals 32, are inserted. A second separation element 33 is further arranged to the mating connector 30, having a sliding face 34 extending in an inclined manner away from the longitudinal axis 1 and contacting, when inserting the portion 31 into the accommodation chamber 16, the outwardly bent arm portions of the contact arms 19 of the short-circuit bridge 18, so that the contact arms 19 are lifted off the connector tabs 26 from the position shown in FIG. 2, before the connector tabs 26 can electrically contact the female con-tact terminals 32.

The invention is not limited to a connector housing having two accommodation chambers only, but may be applied to such connectors having more than two accommodation chambers. More than one short-circuit bridge can be provided if, for example, the contact receiving chambers are arranged in parallel rows.

What is claimed is:

1. A connector housing having a longitudinal axis, comprising:

a first housing portion, having a front end face and a rear end;

at least two accommodation chambers, extending parallel to the longitudinal axis and receiving respectively an electrical contact element, and having a connector tab, wherein the accommodation chambers have, respectively, an insertion opening for a mating contact element and an exiting opening for the connector tab, opening to the front end face;

an elastic locking arm for each accommodation chamber for retaining the contact element in the accommodation chamber;

a second housing portion, which is formed integrally with the first housing portion, and forms an accommodation chamber, into which a portion of a housing of a mating connector can be inserted, having mating contact elements, comprising female contact terminals, which, respectively, can be electrically connected to the contact elements;

a short-circuit bridge, which is made from an electrically conductive material, retained in the first housing portion, comprises for each contact element an elastic contact arm, wherein the contact arms are connected to each other and serve to contact the connector tabs; and a front holder, which can be displaced between an initial position and a final position along the longitudinal axis, which holds in the initial position the contact arms in a lifted position and leaves the same in the final position unloaded, so that these can contact the connector tabs.

2. The connector housing according to claim 1, wherein the front holder is formed frame-like and is taken-up in the final position at least partially in a countersunk manner in the front end face.

3. A connection comprising:

a connector housing according to claim 1 and a mating connector, to which at least one second separation element is arranged, which separates the contact of the contact arms to the connector tabs while connecting to the connector housing.

4. The connector housing according to claim 1, wherein the front holder has at least one first separation element, which holds in the initial position the contact arms of the short-circuit bridge in the lifted position and releases the same in the final position.

5. The connector housing according to claim 4, wherein for each contact arm a first separation element is provided.

6. The connector housing according to claim 1, wherein the front holder has struts extending parallel to the longitudinal axis and supporting a crossbar.

7. The connector housing according to claim 6, wherein the crossbar fills in the final position of the front holder a gap between a wall of the first housing portion and of the outer face of the locking arms facing away from the accommodation chambers in a direction transversally to the longitudinal axis.

* * * * *